United States Patent [19]

Nemoto

[11] 4,422,230

[45] Dec. 27, 1983

[54] METHOD FOR PRODUCING WORKBENCH FOR A WIG

[75] Inventor: Nobuo Nemoto, Chofu, Japan

[73] Assignee: Aderans Co., Ltd., Tokyo, Japan

[21] Appl. No.: 295,979

[22] Filed: Aug. 25, 1981

Related U.S. Application Data

[63] Continuation of Ser. No. 123,231, Feb. 21, 1980, abandoned.

[30] Foreign Application Priority Data

Feb. 28, 1979 [JP] Japan ..... 54-21924
Feb. 28, 1979 [JP] Japan ..... 54-21925

[51] Int. Cl.[3] ..... B29C 24/00; B29C 5/00; B29C 23/00

[52] U.S. Cl. ..... 29/434; 264/222; 264/292; 264/322; 264/337; 264/DIG. 30; 132/5; 132/54; 223/66

[58] Field of Search ..... 29/434; 264/222, 292, 264/255, 46.6, 301, 304, 331, 322, 337, 338, DIG. 30; 269/909; 249/55; 223/66; 248/181; 156/59; 132/5, 54

[56] References Cited

U.S. PATENT DOCUMENTS

| | | | |
|---|---|---|---|
| 3,132,778 | 5/1964 | Leclabart | 223/66 |
| 3,135,814 | 6/1964 | Miller et al. | 264/301 |
| 3,189,035 | 6/1965 | Heck | 132/5 |
| 3,198,408 | 8/1965 | Benner | 223/66 |
| 3,374,301 | 3/1968 | Engles et al. | 264/322 |
| 3,487,133 | 12/1969 | Lindsay | 264/322 |
| 3,498,510 | 3/1970 | Johnson | 269/48.1 |
| 3,557,803 | 1/1971 | Bosshard | 264/222 |
| 3,626,954 | 12/1971 | Ostrom | 132/5 |
| 3,662,057 | 5/1972 | Webster et al. | 262/222 |
| 3,703,571 | 11/1972 | Roberts | 264/255 |
| 4,015,327 | 4/1977 | McCarthy | 264/222 |
| 4,100,122 | 7/1978 | Kent | 264/222 |

FOREIGN PATENT DOCUMENTS

| | | | |
|---|---|---|---|
| 1491209 | 2/1969 | Fed. Rep. of Germany | 264/222 |

*Primary Examiner*—Daniel C. Crane
*Attorney, Agent, or Firm*—Flynn, Thiel, Boutell & Tanis

[57] ABSTRACT

A method for preparing a female mold employing a thermoplastic resin sheet which is softenable and moldable at a relatively low temperature and hardenable at a room temperature. This female mold is accurately profiled by a head of a person who will wear a wig and advantageously employable as a female mold for forming a head model or male mold used for a wig base or used as a workbench for the wig.

4 Claims, 8 Drawing Figures

METHOD FOR PRODUCING WORKBENCH FOR A WIG

This is a continuation of application Ser. No. 123,231, filed Feb. 21, 1980 abandoned.

BACKGROUND OF THE INVENTION

1. Field of the Invention

This invention relates to a method for preparing a female mold for forming a head model for a wig, and more particularly to a method for preparing a female mold to be used for forming a head model which is employable for preparation of a wig base or as a workbench for a wig.

2. Description of Prior Art

In accordance with a known method, a wig base is prepared by employing a flexible synthetic resin sheet such as a vinyl sheet or a polyethylene sheet and an adhesive tape. The flexible synthetic resin sheet is first fitted around the head and the adhesive tape is tied around the so fitted flexible film. The adhesive tape is then applied all over the film to profile the head. This profiled film is used as a female mold to prepare a male mold. A rubber coating or a synthetic resin coating is formed on the male mold and the coating is removed from the mold to obtain a wig base. This method, however, involves such a disadvantage that an accurate wig base can hardly be obtained due to rough formation of the female mold and shrinkage of the materials, i.e., the flexible synthetic resin sheets and the adhesive tape.

OBJECTS OF THE INVENTION

It is therefore an object of the present invention to provide a female mold for forming a head model which is capable of providing a wig base snugly fitted to a head of a wig wearer.

It is another object of the present invention to provide a female mold for forming a head model which is usable as a workbench for carrying out hair grafting and setting of a wig thereon.

SUMMARY OF THE INVENTION

In accordance with the present invention, there is provided a method for preparing a female mold for forming a head model, which comprises:

heating a thermoplastic resin sheet softenable and moldable at a relatively low temperature and hardenable at a room temperature;

pressing said sheet against a head; and cooling said sheet to be hardened.

DESCRIPTION OF THE PREFERRED EMBODIMENTS

Referring now to FIGS. 1 to 4, there is illustrated one embodiment of the present invention which is applied to the manufacturing of a wig base 12. A thermoplastic resin sheet which is softenable and moldable at a relatively low temperature, e.g., at a temperature of 40° to 45° C. where a human body does not get burnt, and hardenable at a room temperature is heated to a temperature higher than the softening point to soften the sheet. The so softened sheet is pressed against the head of a person who will wear a wig to be prepared so as to be swaged and then cooled to harden the sheet for preparing a female mold. A plaster is filled into the female mold to obtain a male mold, i.e., a model of the head. A flexible synthetic resin material is coated on the male mold and dried to obtain a wig base. As a specific example of the thermoplastic resin sheet softenable and moldable at a relatively low temperature and hardenable at a room temperature which is employable in the present invention, there can be mentioned a sheet of a trans-polyisoprene having a thickness of 2 to 3 mm. Natural materials such as balata and guttapercha may also be employed. As the plaster employable for preparing the male mold, there can be mentioned a plaster having a high hardness, high strength and high dimensional accuracy such as a dental plaster. In preparing the wig base by coating the flexible synthetic resin on the plaster male mold, it is preferred that a lubricant be preliminarily coated on the mold. As the lubricant, there may be employed silicone and fluorine plastic.

EXAMPLE 1

Figure 1:
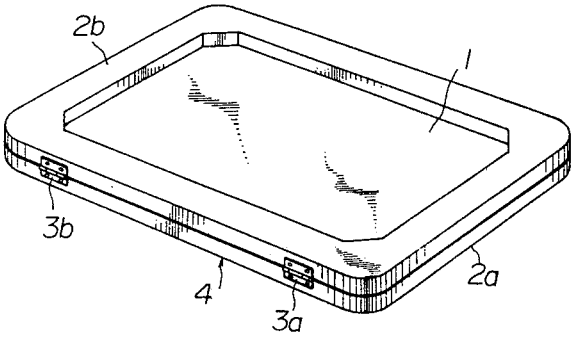
FIG. 1 is a perspective view of a clamping frame holding a material of a female mold.
Figure 2:
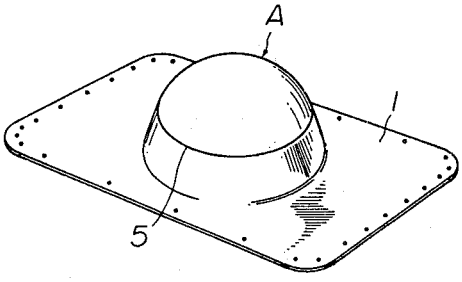
FIG. 2 is a perspective view of the female mold.
Figure 5:
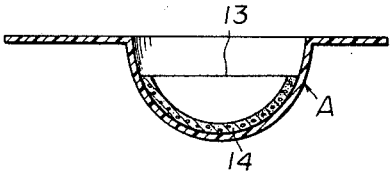
FIG. 5 is a sectional view of a workable resin layer formed inside the female mold.
Figure 6:
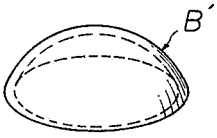
FIG. 6 is a perspective view of a male mold, i.e., a head model, released from the female mold.
Figure 7:
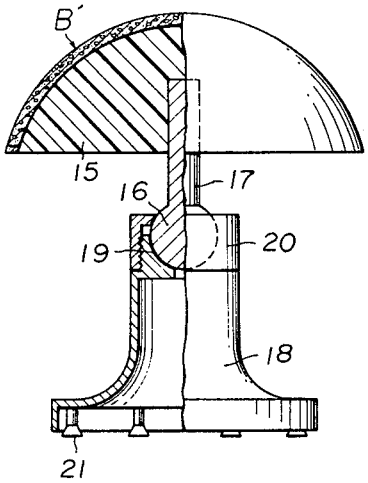
FIG. 7 is a partly sectional elevational view of a workbench for a wig on which the male mold is mounted.

A sheet 1 of Kuraray TP-301 (trade name of trans-1,4-polyisoprene manufactured and sold by Kabushiki Kaisha Kuraray, in Japan; tensile strength (kg/cm$^2$): 290; elongation (%): 450; hardness (Shore C): 78; melting point (°C.): 67; density (g/cm$^3$): 0.96) having a thickness of 2 mm, a length of 33 cm and a width of 33 cm is held by a clamping frame 4 comprised of two wooden frame members **2*a* and 2*b* openably connected by hinges 3*a* and 3*b* as illustrated in FIG. 1. The sheet is held at a height of about 3.5 cm from an electric heater of 445 W at 100 V or 300 W at 120 V and heated by the heater for about three minutes. Then, the semitranslucent sheet is turned transparent and softened. After the sheet is left to cool to a temperature not felt too hot to touch the sheet by a hand, the sheet is pressed against the head of a person who will wear a wig to be prepared, by holding the clamping frame 4 by hands for about seven minutes, until the sheet is cooled to turn semitranslucent again. Then, the sheet is removed from the head to obtain a female mold A as illustrated in FIG. 2. A marking line 5** is drawn in ink to indicate a portion desired for a wig base.

SSS GYPSTONE RC (trade name of a plaster manufactured and sold by SANESU GYPSUN. LTD., Japan) is gradually and dispersedly mixed with water in a basin in the ratio of 100 (g):25 (cc) and stirred for about three minutes. Thus, 1 kg to 2 kg of the mixture is prepared. A small part about ($\frac{1}{3}$) of the thus obtained paste is coated thinly on the inside of the female mold A and the rest is gently poured into the mold. At this time, one end of a stick 6 is placed at a central portion of the poured paste in the female mold A. The plaster is removed from the female mold A after it has passed 15 minutes, i.e., just before it reaches to an exothermic maximum temperature and left for about one hour to complete aggregation, then dried at 40° C. by a drier for 30 minutes and then left half a day to obtain a plaster male mold B. A spherical portion 9 formed at another end of the stick 7 is fitted into a semi-spherical concavity 8 formed at an upper end of a stand 7, and a cap 10 is put thereon to tiltably support the male mold B. The stand 7 has suction pads 11 at a bottom face of the stand 7 so as to fix the stand on a work table.

BU 13 (trade name of a fluorine plastic of low temperature baking type manufactured and sold by PAMPUS) is sprayed onto the plaster mold from a distance of 20 to 35 cm from the mold, dried at a temperature of 60° C. to 70° C. and heated at a temperature of 150° C. for one hour. Polyurethane resin pellets are dissolved by DMF, coated thinly on the plaster mold and dried at a temperature of 60° C. to 70° C. This is repeated three times. The coating is then subjected to a heat treatment at a temperature of 120° C. for ten minutes left for three to four days to harden it completely and removed from the mold to obtain the wig base.

The thus obtained wig base is well fitted to the head of the person who will wear the wig.

FIGS. 5 to 8 illustrate the embodiment of the present invention which is applied to the manufacturing of a workbench for a wig. A fluid workable resin is spread on the inner surface of the female mold for the wig base and removed from the mold to obtain a hollow member. This hollow member is employable as a male mold or a head model on which the wig base is placed for being subject to processing such as a hair grafting, setting, etc.

EXAMPLE 2

A lubricant such as a fluorine plastic is coated on the inside of a female mold as obtained in the manufacturing of the wig base as mentioned above. 100 parts by weight of a fluid workable resin such as a phenolic foam containing an epoxy resin and a phenol balloon which can receive a driven pin after formed is mixed with 25 parts by weight of a hardening agent such as a modified aliphatic polyamine for 2 to 3 minutes. 100 to 150 g of the thus obtained mixture is poured into the female mold with the lubricant coated thereon and spread to a marker 13 for example by a spatula to form a layer 14 of the workable resin in a thickness of about 5 mm and left for 8 to 10 hours to be hardened. The hardened resin is then released to obtain a hollow male mold B'.

Subsequently, an expanded polyurethane 15 is filled into the hollow of the male mold B'. After the polyurethane 15 is hardened, a stick 17 having a spherical portion 16 at a lower end thereof is embedded into the polyurethane 15. The spherical portion 16 is fitted into a semi-spherical concavity 19 formed at an upper end of a stand 18 and a cap 20 is fitted to the stand 18. Thus, a workbench is prepared. Numeral 21 designates suction pads formed on a bottom face of the stand 18.

The thus formed workbench is used in such a manner that the stand 18 is fixed on a table by the suction pads 21, a wig base is placed on the male mold B' to make hair grafting, the wig base is then placed on the mold B' inside out to effect coating on the inside of the wig base, and the wig base is then turned over again on the mold B' to finish setting of the wig. In this connection, it is to be noted that since the wig base is formed by using the same female mold profiled to the head of the wig wearer, the inside configuration of the wig base is in conformity with the outer contour of the workbench and is well fitted thereto. Thus, the above-mentioned operation can be carried out easily and accurately. Furthermore, since the material of the male mold B' provides a fine porous structure to allow driving of a pin, the wig base can be fixed to the workbench more positively.

Figure 8:
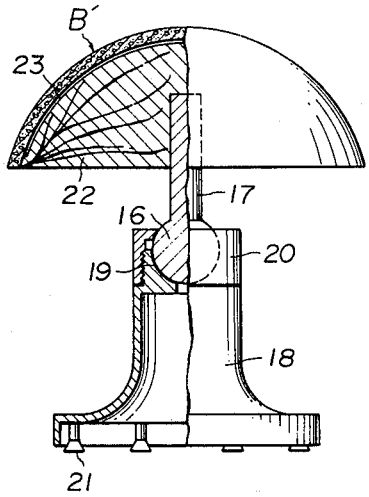
FIG. 8 is a similar partly sectional elevational view of another form of a workbench for a wig.
Figure 3:
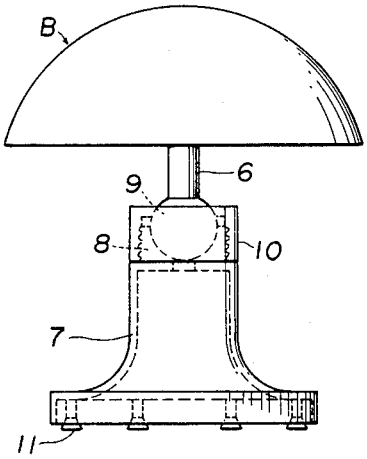
FIG. 3 is an elevational view of a male mold.
Figure 4:
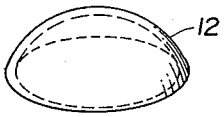
FIG. 4 is a perspective view of a wig base.

FIG. 8 illustrates another form of a workbench wherein a wooden mold 22 is employed in place of the expanded polyurethane. In this case, a gap 23 is formed between the inner face of the mold B' and the outer face of the wooden mold to easily receive a pin driven thereinto.

I claim:

1. In a method for producing a workbench for a wig, fitted to the head of the person who is to wear the wig, the steps comprising:

holding a semitranslucent sheet of trans-1,4-polyisoprene, having a tensile strength about 290 kg/cm$^2$, elongation about 450%, Shore C hardness about 78, density about 0.96 g/cm$^3$, having a length and width about 33 cm, having a melting point of about 67° C. and a thickness of about 2 mm, in a perimetral clamping frame while heating the sheet as a whole to a temperature beyond that at which it softens and until it turns transparent;

allowing the sheet to partially cool to a temperature at which it is still soft and moldable but can be touched by a human hand;

pressing the partially cooled sheet against the top of the head of the person who is to wear the wig sufficient to cause said head to bulge the central portion of said sheet to the shape of the top of said head and maintaining said bulge by holding the clamping frame by hand until the sheet has further cooled sufficient to turn semitranslucent again;

then removing the sheet from the head and marking a line on said bulge to indicate the portion thereof desired for a wig base for use of said bulge as a female mold;

coating a fluorine plastic lubricant on the inside of said female mold;

mixing a fluid workable resin comprising a phenolic foam containing an epoxy resin and phenol balloons with a modified aliphatic polyamine hardening agent;

pouring the thus-obtained mixture into the lubricant coated female mold and spreading same to said marked line to form an open bowl-like layer of the workable resin in a thickness of about 5 mm and leaving same to harden;

thereafter releasing said hardened resin member to obtain a hollow male mold;

subsequently filling the hollow of the male mold with expanded polyurethane and allowing same to harden;

embedding a stick at one end into the polyurethane fill;

fitting a spherical portion at the other end of the stick into a semispherical concavity formed at an upper end of a stand and fitting a cap to the stand to hold said spherical portion, to thereby prepare a workbench for said wig, the workbench being fitted to the head of the person who is to wear the wig made thereon.

2. The method of claim 1 in which said mixing step includes mixing about 100 parts by weight of said fluid workable resin with about 25 parts by weight of said hardening agent for 2 to 3 minutes.

3. The method of claim 1, in which said holding step includes holding said sheet between two wooden frame members operably connected by hinges and defining said clamping frame;

said heating step including locating the framed sheet at a height of about 3.5 cm from an electric heater of about 300 W to 445 W for about three minutes;

wherein said pressing step includes urging said clamping frame to maintain said bulge for about seven minutes;

said mixing step includes mixing about 100 parts by weight of said fluid workable resin with about 25 parts by weight of said hardening agent for 2 to 3 minutes; and said pouring step uses about 100 to 150 g of said mixture.

4. In a method for producing a workbench for a wig, fitted to the head of the person who is to wear the wig, the steps comprising:

providing a semitranslucent trans-1, 4-polyisoprene sheet of tensile strength about 290 kg/cm$^2$, elongation about 450%, Shore C hardness about 78, density about 0.96 g/cm$^3$, having a length and width about 33 cm and having a melting point of about 67° C. and a thickness of about 2 mm and which is soft and moldable about 40° C. to 45° C. but hard at room temperature;

holding said semitranslucent sheet of trans-1,4-polyisoprene between two wooden frame members openably connected by hinges and defining a perimetral clamping frame;

heating the sheet so held in the perimetral clamping frame to a temperature beyond the softening point and until it turns transparent, said heating step including locating the framed sheet at a height of about 3.5 cm from an electric heater of about 300 W to 445 W for about three minutes;

allowing the sheet to partially cool to a temperature at which it is still soft and moldable but at which it can be touched by a human hand;

pressing the partially cooled sheet against the top of the head of the person who is to wear the wig sufficient to cause said head to bulge the central portion of said sheet to the shape of the top of said head and maintaining said bulge by holding the clamping frame by hand until the sheet is cooled sufficient to turn semitranslucent again;

then removing the sheet from the head and marking a line on said bulge to indicate the portion thereof desired for a wig base for use of said bulge as a female mold;

coating a fluorine plastic lubricant on the inside of said female mold;

mixing a fluid workable resin comprising a phenolic foam containing an epoxy resin and phenol balloons with a modified aliphatic polyamine hardening agent, said mixing step including mixing about 100 parts by weight of said fluid workable resin with about 25 parts by weight of said hardening agent for 2 to 3 minutes;

pouring about 100 to 150 g of the thus-obtained mixture into the lubricant coated female mold and spreading same to said marked line to form an open bowl-like layer of the workable resin in a thickness of about 5 mm and leaving same to harden;

thereafter releasing said hardened resin member to obtain a hollow male mold;

subsequently filling the hollow of the male mold with expanded polyurethane and allowing same to harden;

embedding a stick at one end into the polyurethane fill;

fitting a spherical portion at the other end of the stick into a semispherical concavity formed at an upper end of a stand and fitting a cap to the stand to hold said spherical portion, to thereby prepare a workbench for said wig, the workbench being fitted to the head of the person who is to wear the wig made thereon.

* * * * *